United States Patent [19]

Bode

[11] 4,158,751

[45] Jun. 19, 1979

[54] ANALOG SPEECH ENCODER AND DECODER

[76] Inventor: Harald E. W. Bode, 1344 Abington Pl., North Tonawanda, N.Y. 14120

[21] Appl. No.: 875,686

[22] Filed: Feb. 6, 1978

[51] Int. Cl.[2] ..... G10L 1/00

[52] U.S. Cl. ..... 179/1 SA

[58] Field of Search ..... 179/1 SA, 1 SC, 1 SD, 179/1 SB

[56] References Cited

U.S. PATENT DOCUMENTS

| | | | |
|---|---|---|---|
| 3,872,250 | 3/1975 | Coulter | 179/1 SA |
| 3,903,366 | 9/1975 | Coulter | 179/1 SA |

*Primary Examiner*—Kathleen H. Claffy
*Assistant Examiner*—E. S. Kemeny
*Attorney, Agent, or Firm*—Martin Lukacher

[57] ABSTRACT

Described herein are analog speech encoder and decoder systems using a plurality of narrow band pass filters with associated rectifiers and ripple filters for spectrum analyzing the speech or other suitable signals, and a corresponding plurality of narrow band pass filters with associated voltage controlled amplifiers for remaking the speech with either an injected carrier or a noise signal being applied to the voltage controlled amplifier inputs, said carrier or noise source signals being selected by a voice controlled circuit, activating the carrier in the presence of voiced sounds or vowels, and the noise source in the presence of unvoiced sounds or consonants; said innovations or the combination thereof consisting of (1) the use of a direct bypass for the high speech frequencies from the voice input to the decoder output, using a high pass filter essentially passing the unvoiced speech sounds, (2) the limitation of the bandpass filter range of the encoder and decoder sections to the cut-off frequency of the high pass filter, (3) switching means to include voice controlled circuitry to activate the high frequency bypass only in the presence of unvoiced speech sounds, (4) switching means to include a noise source for the simulation of unvoiced sounds in the range of the band pass filters below the cut-off frequency of the aforesaid high pass filter, when activated by the voice controlled circuitry, and (5) the inclusion of an amplitude compressing circuit at the voice input and an amplitude expanding circuit at the decoder output for the purpose of increasing the signal-to-noise ratio of the speech encoder and decoder.

19 Claims, 4 Drawing Figures

ANALOG SPEECH ENCODER AND DECODER

Figure 1:
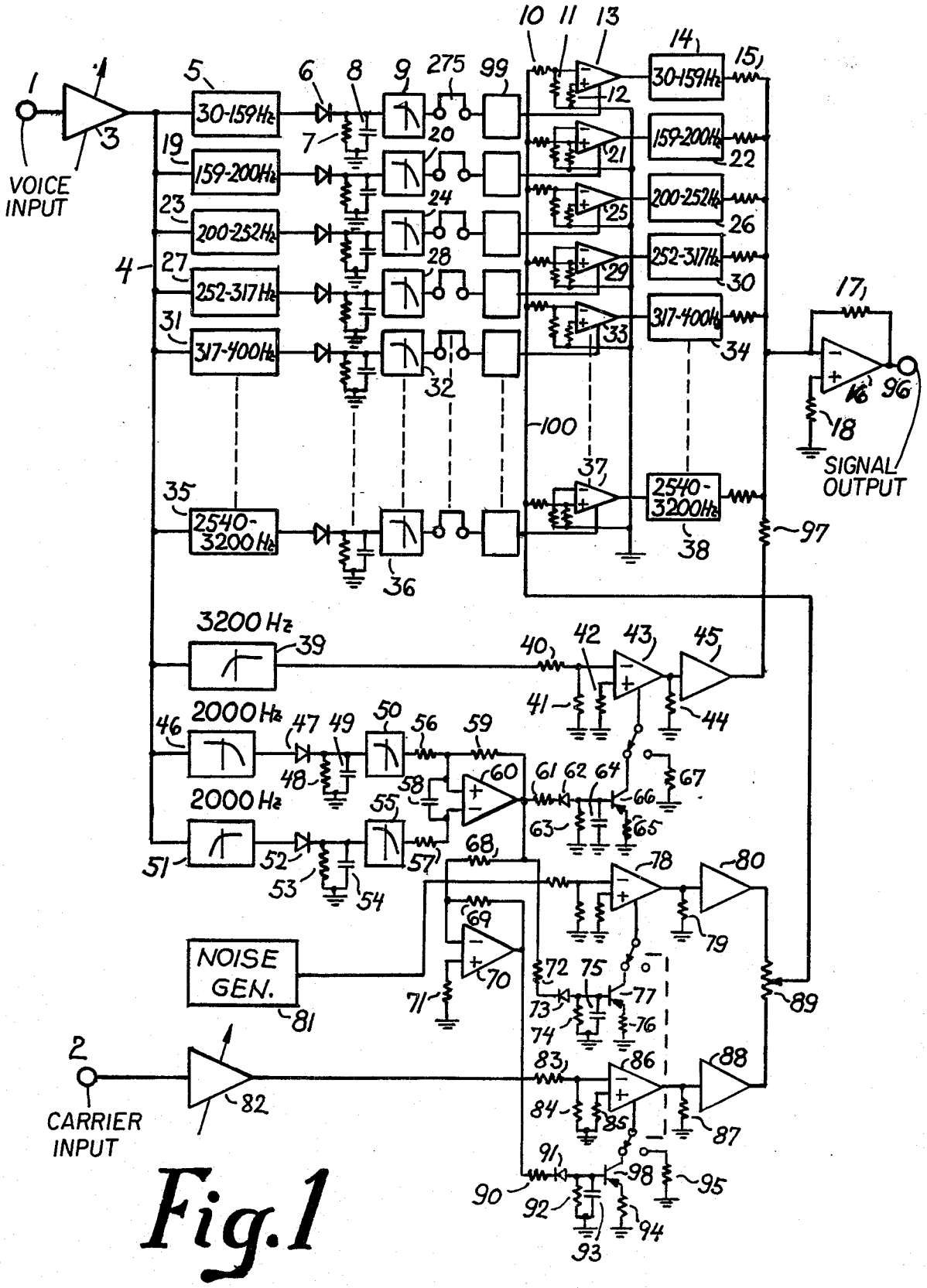

This invention relates to an analog encoder and decoder for speech or other suitable sounds, and more particularly it is concerned with the real time extraction of the overtone structure of speech or other selected sounds and with the transfer of this overtone structure onto carrier signals with a sufficient amount of overtones, so as to have the carrier "speak" or "sing" or perform with the characteristics of the original sound entered into the encoder input.

It is an object of the present invention to provide an apparatus which performs with significantly improved intelligibility and fidelity.

It is a further object of the invention to provide an apparatus with substantially simplified circuitry.

A further object of the invention is to provide an analog speech encoder and decoder with improved reliability of performance.

Another object of the invention is to provide an utmost versatile analog speech encoder and decoder.

Still another object of the invention is to provide an analog speech encoder and decoder with a substantially improved signal-to-noise ratio.

In order to properly assess the above objectives, it will be helpful and necessary to establish a clear distinction between the present invention and existing analog encoders and decoders of this kind.

Known analog encoders and decoders for the transfer of the overtone structure of speech or other suitable sounds onto a new carrier operate with a plurality of narrow band pass filters covering the entire speech frequency range, each of said band pass filters being associated with a rectifier and a ripple filter in the encoder section for generating control voltages corresponding to the relative amplitudes of the overtones of the speech or other selected sounds fed into the input, and a plurality of narrow band pass filters in the decoder section, corresponding to those in the encoder section and being preceded by voltage controlled amplifiers. Furthermore known encoders and decoders of this kind comprise means for synthesizing unvoiced sounds such as "s" sounds or consonants, said means consisting of a noise generator and voice activated circuitry, which latter one feeds the noise signal into the decoder section in the presence of "s" sounds or consonants, and which feeds the carrier signal into the decoder section in the presence of vowels or voiced sounds.

This switching process is always connected with a finite time constant, which in the case of explosive consonants, such as b, p, d, t, g, k, and q may severely impair the faithful processing of speech sounds. It has been discovered, now, that when excluding a high frequency portion of the speech sound from the process of encoding and decoding and feeding it directly from the input of the encoder to the output of the decoder, where it is re-combined with the signals processed in the lower frequency range, the intelligibility and fidelity can be substantially enhanced without adversely affecting the intended performance of the processed voiced sounds.

It is, therefore, a major feature of this invention to circumvent at least a portion of the synthesis of unvoiced sounds through the use of a direct bypass for the higher frequencies from the voice input to the decoder output. In practice a bypass for the frequencies above 3200 Hz has proven very effective, dramatically improving the intelligibility of the system and not interfering with the encoding and decoding of voiced sounds below 3200 Hz due to the masking effect, which completely preserves the pitch (or pitches) of the carrier injected into the decoder input without revealing the remaining overtones of a voiced sound fed through the high frequency bypass.

Figure 2:
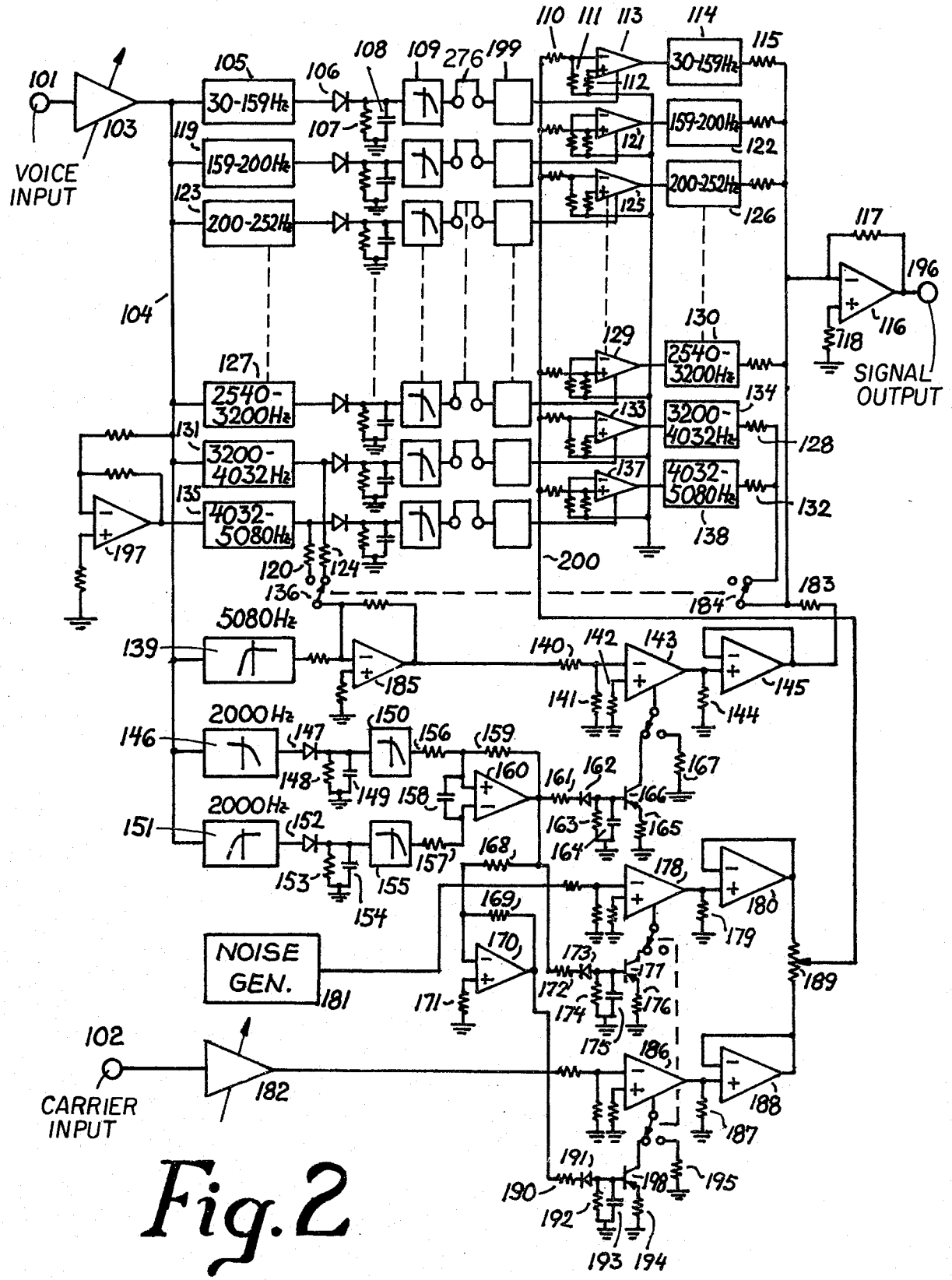
Figure 3:
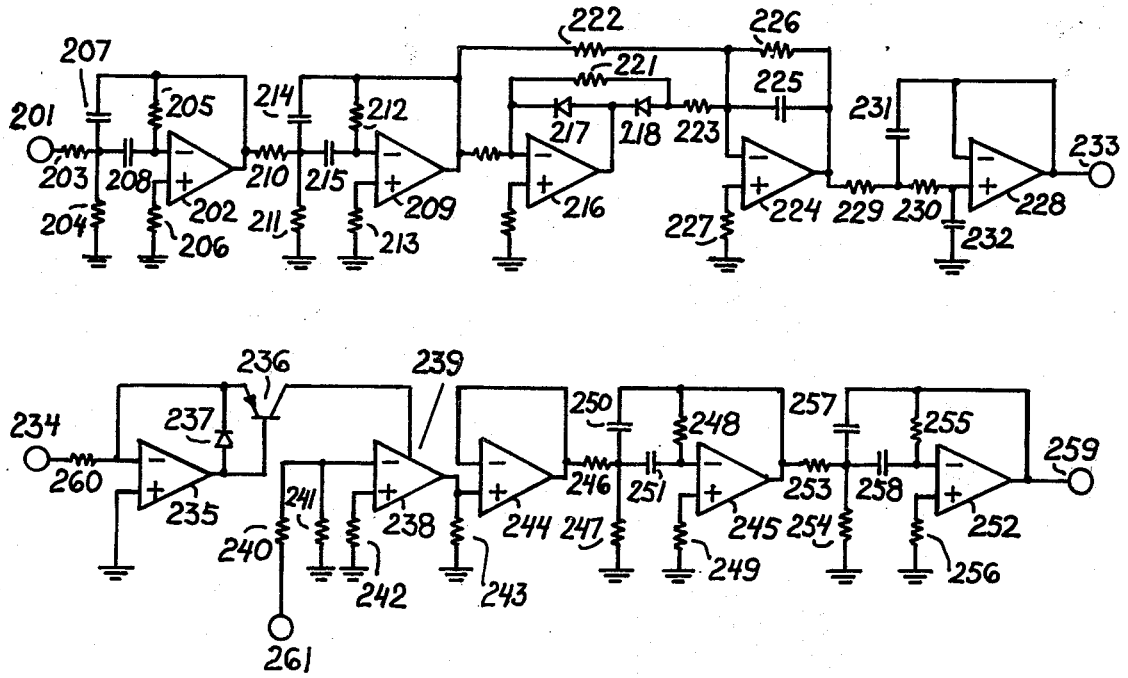
Figure 4:
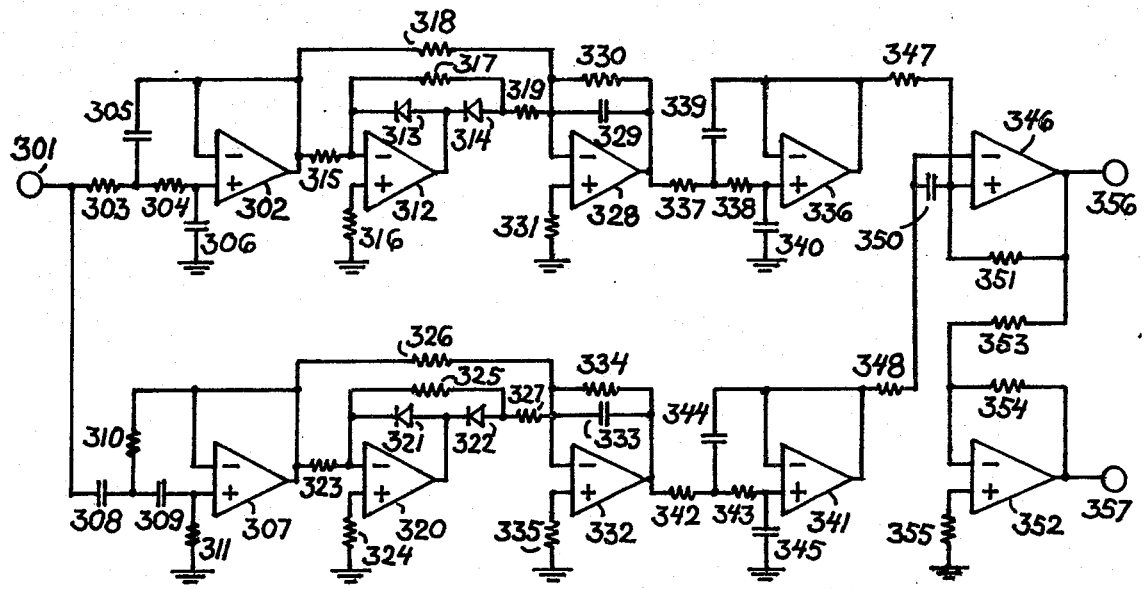

Other novel features of this invention, together with further objects and advantages thereof, will become more readily apparent when considered in connection with the accompanying drawings, in which:

FIG. 1 is a block schematic diagram of an analog speech encoder and decoder according to the invention with a high frequency bypass and means for synthesizing non-bypassed portions of the speech frequencies, FIG. 2 is a block schematic diagram of an analog speech encoder and decoder according to the invention with a high frequency bypass and an extended range encoding and decoding section, FIG. 3 is a schematic diagram of a typical encoder and decoder channel, and FIG. 4 is a schematic diagram of the control circuitry for performing the vowel/consonant discrimination and switching functions.

Referring now to the drawings and more particularly to FIG. 1, it will be observed, that numeral 1 refers to the input terminal for voice and other suitable audio signals. Numeral 2 represents the input terminal for the carrier signal. The voice signal received at terminal 1 is fed through an amplifier 3 to a signal bus 4, which in turn feeds into the band pass filters 5, 19, 23, 27, 31, and so forth through 35, and furthermore into the high pass filter 39, the low pass filter 46, and the high pass filter 51. The band pass filters 19 through 35 represent a total of 13 of the 5 one third octave filters shown in FIG. 1, constituting the encoder filter bank of this particular example of execution. The high pass filter 39 represents the high frequency bypass, also including the switching stage 43 and the voltage follower 45, feeding into the output stage 16.

Returning now to the encoder section, it will be recognized, that the outputs of the band pass filters 5, 19, 23, 27, 31, and so forth through 35 feed into rectifiers, such as represented by numeral 6, with associated bleeding resistors (numeral 7) and filter capacitors (numeral 8) and furthermore into low pass filters (numeral 9) for ripple filtering. Through known circuitry symbolized by black box 99 the control voltages obtained at the low pass filter outputs (numeral 9) are converted into control currents and fed into the control terminals of the operational transconductance amplifiers 13, 21, 25, 29, 33, and so forth through 37. These operational transconductance amplifiers act as voltage controlled amplifiers, the gain of which is in direct proportion to the control voltages obtained at the low pass ripple filter outputs, and to the signal amplitudes present in the individual band pass filters of the encoder section.

Referring now to further details of the decoder section, it will be recognized, that the outputs of the operational transconductance amplifiers are connected to the band pass filters 14, 22, 26, 30, 34 and so forth through 38, and it will be further recognized, that the frequency range of each encoder filter is identical with that of the corresponding decoder filter, unless the direct signal paths between the ripple filters 9 and the current sources 99 are opened and the ripple filter outputs and current source inputs are connected to special terminals 275 to facilitate the making of cross-connections between encoder channels of one frequency range to decoder channels of another frequency range.

The operational transconductance amplifiers of the decoder section receive their audio input signals through a signal bus 100, which alternately carries the voiced signal of the carrier or the unvoiced signal of a noise generators, depending upon the nature of the speech signal at terminal 1, as will be discussed further below. It will be observed, that the signal bus 100 feeds alternately into the inverting and the non-inverting inputs of the operational transconductance amplifiers 13, 21, 25, 29, 33, and so forth through 37. This is believed desirable to the reversal of phase in the response of the band pass filters, which is greatest between the −3dB point on one side and at the −3dB point on the other side of the filter range.

Referring now to the voice activated switching circuitry, the low pass filter 46 will be recognized, which feeds into the diode 47 with the associated bleeding resistor 48 and charging capacitor 49, from which the rectified voltage enters the ripple filter 50. Furthermore the high pass filter 51 will be recognized, feeding into the diode 52 with the associated bleeding resistor 53 and the charging capacitor 54, from which the rectified voltage enters the ripple filter 55. If now the total signal energy below 2000 Hz exceeds that above 2000 Hz, such as in speech vowels, the positive D.C. voltage obtained at the output of ripple filter 50 exceeds that obtained at the output of ripple filter 55, and the output of comparator 60 will turn positive. If, on the other hand, the total signal energy above 2000 Hz exceeds that below 2000 Hz such as in "s" sounds, the positive D.C. voltage at the output of the ripple filter 55 exceeds that obtained at the output of ripple filter 50, and the output of the comparator 60 will turn negative. The output of the comparator 60 is followed by an inverter stage 70, at the output of which voltages of opposite polarity are obtained.

The output of the comparator is connected to a current control circuit comprising the resistor 61, diode 62, bleeding resistor 63, charging capacitor 64, and transistor 66 with the emitter resistor 65, the collector of said transistor being connected through a switch to the control terminal of the operational transconductance amplifier 43, which functions as a voltage controlled gain stage. When the output of comparator 60 becomes negative, which happens, when the "s" sound energy from signal bus 4 exceeds that of the voiced sounds, the just described current control circuit turns on the amplifier 43. In a similar manner the operational transconductance amplifier 78 is being turned on, when the output of comparator 60 goes negative.

When the output of comparator 60 goes positive, as this is the case, when the vowel sound energy exceeds that of the "s" sounds, the output of the inverter stage 70 goes negative, and the operational transconductance amplifier 86 is being turned on through the interaction of the current control circuitry, comprising the resistor 90, diode 91, bleeding resistor 92, charging capacitor 93 and the transistor 98 with the emitter resistor 94, assuming, that the switch between the collector of transistor 98 and the control input of amplifier 86 is in the position shown in FIG. 1.

Thus, in reviewing the performance of the voice activated circuit, with the switches at the control inputs of the operational transconductance amplifiers in the positions shown in FIG. 1, (a) the high frequency bypass above 3200 Hz is activated in the presence of "s" sounds, (b) the noise generator is activated through the presence of "s" sounds, and (c) the carrier signal is activated through the presence of vowels or pitched sounds below 2000 Hz. By turning the control switch under amplifier 43 to the right hand position and providing a fixed bias through resistor 67, the high frequency bypass is activated at all times, which for some uses of the system is desirable. By turning the switches under 78 and under 86 (which may be ganged together) to the right hand position, the noise generator is turned off, and the voice activated switching circuit is disabled for voltage controlled amplifier 86, which now receives a fixed bias through resistor 95 and operates at a fixed gain. This switch setting is most effective with the switch under 43 set for stable gain or for the unswitched mode of the high frequency bypass channel.

The volume of the high frequency bypass, which feeds into the output summing stage 16 together with the decoder output filters, does not need any volume adjustment once the gain is established through proper component selection. The relative volume of the noise generator and the carrier source from input 2 is adjusted with the aid of potentiometer 89. In the interest of achieving optimum signal-to-noise ratio, the input circuits associated with amplifiers 3 and 82 are equipped with overload indicating circuitry such as known for audio systems and not shown in FIG. 1. Furthermore an additional improvement of the signal-to-noise ratio may be achieved by inserting in a known manner automatic gain control circuitry for dynamic compression in the voice input path and associated automatic gain control circuitry for dynamic expansion in the output path.

It should be understood, that the circuitry shown in FIG. 1 and described herein may be modified and extended within the spirit and scope of this invention. For instance, the range of the narrow band pass filters of the encoder and decoder sections may be extended beyond the 3200 Hz limit for improvement of the voiced sounds or other sounds that may be selected for processing. The example of such an extended system is shown in FIG. 2.

When comparing the analog encoder and decoder of FIG. 2 with that of FIG. 1, many similarities will be discovered. The major differences between the system of FIG. 2 and the system according to FIG. 1 are the following:

(a) The bandpass filter ranges of both the encoder and the decoder sections in the system according to FIG. 2 are extended to 5080 Hz, incorporating filters 131 and 135 in the encoder section and filters 134 and 138 in the decoder section. Both the encoder and the decoder section are also extended by the associated rectifiers and ripple filters in the encoder section and the associated current sources and operational transconductance amplifiers 133 and 137 in the decoder section, and have special terminals 276, like terminals 275 in FIG. 1, for making of cross connections between encoder and decoder channels.

(b) The high frequency bypass can be switched to a crossover frequency of 5080 Hz, as shown in the example presented in FIG. 2, with switch 136 open and switch 184 closed, and the high frequency portion of the input signal passing through high pass filter 139, the summing stage 185, the voltage controlled amplifier or gate 143, the voltage follower 145 and the resistor 183 to the output summing amplifier 116; or it can be switched to a crossover frequency of 3200 Hz with the switch 136 closed and the switch 184 open, in which case the encoder filter outputs for the frequency ranges from 3200–4032 Hz and from 4032–5080 Hz feed the signal from the bus 104 into the summing stage 185, extending the direct bypass down to 3200 Hz, while the output signals from the decoder filters for the ranges from 3200–4032 Hz and from 4032–5080 Hz are prevented from reaching the output summing stage 116.

It will be noted in the example shown in FIG. 2, that the encoder filter 135 is preceded by an inverter stage 197. This is done for the purpose of avoiding signal cancellations at the crossover frequencies between filters 131 and 135 as well as between filters 135 and 139, due to the phase response of the band pass filters, which is greatest between at the −3dB point on one side and the −3dB point on the other side of the filter range, and a similar phase relationship between band pass filter 135 and the adjoining high pass filter 139.

In the example presented in FIG. 2 the selectable crossover frequencies are limited to 3200 and 5080 Hz, but it will be understood, that with the number of band pass filters shown it could be extended to include a third frequency, namely 4032 Hz. Furthermore additional band pass filters could be added to extend the range of the encoder and decoder upward, although there will be a practical limit to make the high frequency bypass effective. It should also be understood, that band pass filters for frequency ranges of less than the ⅓ octave filters shown in the examples of FIG. 1 and FIG. 2 could be employed.

Furthermore the rectifiers identified by numeral 106 in FIG. 2, being typical for all rectifiers following the encoder filters, as well as those identified by numerals 147 and 152, may be substituted by precision full wave rectifiers according to the state-of-the-art.

Full circuit details of one typical encoder and decoder channel are shown in FIG. 3. Here the encoder band pass filter is represented by the operational amplifiers 202 and 209 with the associated passive components. Typically the operational amplifier together with the resistors 203, 204, 205, and 206, and the capacitors 207 and 208 represents a known circuit configuration of a resonance filter. The same is true for operational amplifier 209 in conjunction with the resistors 210, 211, 212, and 213, and the capacitors 214 and 215. When now placing the resonance frequency of one of the resonance filters by a factor of 1.0865 below the center frequency of a given third octave range and the resonance frequency of the other resonance filter by a factor of 1.0865 above said center frequency, and when furthermore designing said resonance filters for a Q of 7.7 and a gain of 1.75, a band pass filter is obtained from the combination of the two resonance filters with unity gain, with a −3dB drop at both edges of the third octave range and with a drop of about 36dB per octave on both sides of the filter range.

Referring further to the circuit details shown in FIG. 3, a precision full wave rectifier of known design will be recognized, comprising the operational amplifier 216, the diodes 217 and 218 and the resistors 219, 220, 221, 222, and 223, said precision full wave rectifier being connected to the integrator stage with operational amplifier 224, capacitors 225, and resistors 226 and 227.

The integrator stage with operational amplifier 224 is followed by a low pass ripple filter with the operational amplifier 228, the resistors 229 and 230 and the capacitors 231 and 232. Due to the employment of a precision rectifier the D.C. voltages obtained at the output terminal 233 track very closely with the signal amplitudes fed into the input terminal 201.

The D.C. control voltages obtained at the output terminal 233 of the encoder channel are fed to the input terminal 234 of the decoder channel. At the input of this channel a precision current source of known design will be recognized, comprising the operational amplifier 235 with the transistor 236 and the diode 237 and furthermore with the input resistor 260. This precision current source responds to positive D.C. control voltages produced in the encoder section. The size of input resistor 260 determines the amount of control current fed to the control input 239 of the operational transconductance amplifier 238, which, in conjunction with the precision current source, performs as a voltage controlled amplifier. The carrier signal is applied to the carrier input terminal 261 and through resistor 240 to the inverting input of the operational transconductance amplifier 238. Both the inverting and the non-inverting inputs of 238 are shunted to ground through relatively smaller resistors 241 and 242. The stage 238 is terminated by a load resistor 243 and followed by a voltage follower with the operational amplifier 244 in order to provide a low impedance signal source for the filter stages with operational amplifiers 245 and 252 with their associated passive components. The resonance filters with operational amplifiers 245 and 252 have precisely the same function as the resonance filters with the operational amplifiers 202 and 209 as described in detail for the encoder section. The decoded signals are derived at the output terminal 259, and are summed with the decoded signals of the other channels as described in detail of FIG. 1 and FIG. 2.

Referring now to FIG. 4, the control circuit for performing the vowel/consonant discrimination will be recognized. Numeral 301 refers to the input terminal for the voice signal. Operational amplifier 302 with the resistors 303 and 304 and the capacitors 305 and 306 constitutes a low pass filter for the passing of the voiced sounds, typically being under 2000 Hz. Operational amplifier 307 with the capacitors 308 and 309 and the resistors 310 and 311 constitutes a high pass filter for the passing of the consonants and "s" sounds, typically being above 2000 Hz. Both the low pass filter with operational amplifier 302 and the high pass filter with operational amplifier 307 are followed by precision full wave rectifiers with operational amplifier 312 with associated components for the voiced sound or vowel channel and with operational amplifier 320 and associated components for the consonant or "s" sound channel. Both precision full wave rectifiers are followed by integrator stages with the operational amplifier 328 and associated components in the vowel channel and operational amplifier 332 with associated components in the consonant channel, and finally both integrators are followed by low pass ripple filters with operational amplifier 336 with its associated components in the vowel channel and operational amplifier 341 with its associated components in the consonant channel. The D.C. voltages obtained at the output of operational amplifier 336 are fed through resistor 347 to the non-inverting input of operational amplifier 346, which performs as a comparator. The D.C. voltages obtained at the output of operational amplifier 341 are fed through resistor 348 to the inverting input of said comparator 346. For the purpose of further ripple suppression a filter capacitor 350 is provided between the inverting and non-inverting input terminals of operational amplifier 346. Also for the same purpose and for eliminating the unwanted effects of any signal level indecision a high value positive feedback resistor 351 is provided to cause a slight latching on to the last signal received at either input terminal of the comparator 346.

At the output terminal 356 of comparator 346 a positive D.C. voltage is obtained, when the voiced sound energy exceeds the energy of the consonants or "s" sounds. In contrast a negative D.C. voltage is obtained, when the energy of the consonants or "s" sounds exceeds that of the voiced sounds or vowels.

The output of comparator 346 is followed by an inverting stage with operational amplifier 352, so that the D.C. voltages obtained at the output terminal 357 are the inverse of those obtained at terminal 356. The output of 346 is fed into the switching circuits for the high frequency bypass signals and the noise source signals, and the output of 352 is fed into the switching circuit for the carrier signal. Details of these switching circuits were discussed in the description of the block schematic diagram shown in FIG. 1.

A number of modifications of or additions to the systems and circuits described herein may occur to those skilled in the art. These may, for instance, include an amplitude follower circuit comprising a precision rectifier and a ripple filter in the carrier input channel and a voltage controlled amplifier in the noise generator channel, so that the signal level from the noise generator is always in the right proportion to the level of the carrier signal.

Further modifications of or additions to the systems or circuits described herein would include sample and hold circuits of known design to sustain at will the encoded vowel information obtained at a given instant.

Various other modifications within the spirit and scope of the invention will no doubt occur to those skilled in the art, so that the invention should not be deemed to be limited only to those embodiments and modifications thereof having been illustrated and described in detail. Rather the invention should be deemed to be limited only by the scope of the appended claims.

What is claimed is:

1. The method of processing speech which comprises the steps of encoding speech into a multiplicity of signals corresponding to the amplitude of said speech in successive portions of the lower and midrange of the frequency spectrum of said speech which includes voiced speech and into control signals representing when said speech is voiced and when said speech is unvoiced, and decoding said multiplicity of signals said decoding step comprising the steps of admitting carrier and noise signals, then transmitting successive portions of the spectrum of said carrier signals when said control signals representing said voiced speech are present and successive portions of the spectrum of said noise signals when said control signals representing unvoiced speech are present, said successive portions of the spectrum of said noise and carrier signals and said successive portions of said speech signals corresponding to each other, varying the amplitudes of said portions of said spectrums of said carrier and noise signals which are transmitted in accordance with the amplitudes of said encoded signals from portions of said spectrum of said speech which correspond thereto, transmitting the higher range of the spectrum of said speech which includes unvoiced speech, and combining said higher range of said speech spectrum and said portions of said carrier and noise signals which are transmitted to reproduce said speech.

2. The method as set forth in claim 1 wherein the lower and midrange of said spectrum of said speech which includes said voiced sounds and the higher range of spectrum of said speech which includes said unvoiced sounds have a frequency cross over at about 3000 Hz.

3. The method as set forth in claim 1 wherein said step of transmitting the higher range of said spectrum is carried out only when said control signals representing said unvoiced speech are present.

4. The method of encoding and decoding speech having voiced and unvoiced sounds which lie in the lower and higher portions of the frequency spectrum of speech, said method comprising the steps of translating speech into analog electrical signals, filtering said signals to separate said signals in accordance with the frequency thereof into a multiplicity of narrow band signals, said narrow band covering all of the spectrum of said speech which includes said voiced sounds, rectifying and ripple filtering said signals in each of said bands to produce a multiplicity of encoded signals corresponding to the amplitude of said analog signals filtered into said bands, selectively activating a carrier signal in the presence of voiced sounds in said speech and a noise signal in the presence of unvoiced sounds in said speech, varying the amplitudes of the activated carrier or noise signal which are contained in a multiplicity of frequency bands corresponding to said narrow bands in accordance with the amplitude of the encoded signals from the corresponding bands, high pass filtering said analog electrical signals to directly pass components thereof corresponding to the unvoiced speech sound components which are contained in the higher portion spectrum of said speech, and combining said high pass filtered signals and said amplitude varied carrier or noise signals at a signal output to provide a signal output representing decoded speech.

5. The method as set forth in claim 4 including the step of also combining at least one of said multiplicity of narrow band signals at the upper end of the lower portion of said spectrum of speech with said high passed analog signals and said noise or carrier signals at said signal output.

6. The method as set forth in claim 4 including the step of activating said step of high pass filtering of said analog electrical signals to pass the components thereof corresponding to the unvoiced spectrum components for combining only when said unvoiced sound components are present.

7. The method as set forth in claim 6 including the step of detecting when the amplitude of said analog electrical signals which lie in a first band of frequencies including said higher portions of said spectrum of speech exceeds and does not exceed the amplitude of said analog electrical signals in a second band of frequencies containing frequencies below said first band and including said lower portions of said spectrum of speech, and wherein said step of selectively activating said noise and carrier signals is carried out upon detection of when said amplitude of said analog electrical signals in said first band exceeds and does not exceed said amplitude of said electrical signals in said second band, respectively, and wherein said step of activating said step of high pass filtering of said analog electrical signals is carried out only upon detection of when said amplitude of said analog electrical signals in said first band exceeds said amplitude of said electrical signal in said second band.

8. The method as set forth in claim 7 wherein said second band includes all frequencies contained in the spectrum of said analog electrical signals which are below about 2 KHz and said second band includes all frequencies contained in the spectrum of said analog electrical signals which are above about 2 KHz and said higher portion includes all frequencies in said frequency spectrum of speech above about 3.2 KHz.

9. The method as set forth in claim 5 wherein said high pass filtered analog signals contain frequency components of said analog signals above about 5 KHz, and said one of said multiplicity of narrow bands is selected from a band adjacent about 5 Khz and a band next adjacent said band which is adjacent about 5 KHz.

10. A system for encoding and decoding speech having voiced and unvoiced sounds which lie in the lower and higher portions of the frequency spectrum of speech, said system comprising means for translating speech into analog electrical signals, means for filtering said signals to separate said signals in accordance with the frequency thereof into a multiplicity of narrow band signals, said narrow bands covering all of the spectrum of said speech which includes said voiced sounds, means for rectifying and ripple filtering said signals in each of said bands to produce a multiplicity of encoded signals corresponding to the amplitude of said analog signals filtered into said bands, means for providing a source of carrier signal, means for providing a source of noise signal, means for selecting said carrier signal in the presence of voiced sounds in said speech and said noise signal in the presence of unvoiced sounds in said speech, means for varying the amplitudes of the selected carrier or noise signal which are contained in a multiplicity of frequency bands corresponding to said narrow bands in accordance with the amplitudes of the encoded signals from the corresponding bands, means for high pass filtering said analog electrical signals to directly pass components thereof corresponding to the unvoiced speech sound components which are contained in the higher portion spectrum of said speech, and means for combining said high pass filtered signals and said amplitude varied carrier or noise signals to provide a signal output representing decoded speech.

11. The system as set forth in claim 10 including means for also combining at least one of said multiplicity of narrow band signals at the upper end of the lower portion of said spectrum of speech with said high passed analog signals and said noise or carrier signals to provide said signal output.

12. The system as set forth in claim 10 including means for activating said high pass filtering means to pass the components thereof corresponding to said unvoiced speech components to said combining means only when said unvoiced sound components are present.

13. The system as set forth in claim 12 including means for detecting when the amplitude of said analog electrical signals which lie in a first band of frequencies including said higher portions of said spectrum of speech exceeds and does not exceed the amplitude of said analog electrical signals in a second band of frequencies containing frequencies below said first band and including said lower portions of said spectrum of speech, and wherein said means for selecting said noise and carrier signals is operated by said detecting means upon detection of when said amplitude of said analog electrical signals in said first band exceeds and does not exceed said amplitude of said electrical signals in said second band, respectively, and wherein said means for activating said high pass filtering of said analog electrical signals is operative only upon detection of when said amplitude of said analog electrical signals in said first band exceeds said amplitude of said electrical signal in said second band.

14. The method as set forth in claim 13 wherein said second band includes all frequencies contained in the spectrum of said analog electrical signals which are below about 2 KHz and said first band includes all frequencies contained in the spectrum of said analog electrical signals which are above about 2 KHz and said high portion includes all frequencies in said frequency spectrum of speech above about 3.2 KHz.

15. The system as set forth in claim 11 wherein said high pass filtered analog signals contain frequency components of said analog signals above about 5 KHz, and said one of said multiplicity of narrow bands is selected from a band adjacent about 5 KHz and a band adjacent said band which is adjacent about 5 KHz.

16. The system as set forth in claim 10 wherein said means for varying the amplitudes of said selected carrier signal or noise signal comprise a multiplicity of operational transconductance amplifiers each having a gain control input and signal input for said selected carrier signal or noise signal and outputs, a multiplicity of filters each for passing a different one of said narrow bands, said outputs of said amplifiers being connected to said filters, and means for applying said encoded signals to said gain control inputs with each amplifier receiving as its gain control input an encoded signal produced from a different one of said narrow bands and with one of said filters connected to its output for filtering the same narrow band.

17. The system as set forth in claim 16 wherein said applying means includes current sources between said gain control inputs and said rectifying and ripple filtering means.

18. The system as set forth in claim 13 wherein said means for selecting said noise or carrier signals and for activating said high pass filtering means includes separate operational transconductance amplifiers having control inputs, and means for applying control signal outputs from said detection means to said control inputs.

19. The invention as set forth in claim 10 wherein said narrow band filtering means for said analog signals and said varying means for said selected noise and carrier signals comprise operational amplifier filters.

* * * * *

UNITED STATES PATENT OFFICE

CERTIFICATE OF CORRECTION

Patent No. 4,158,751 Dated June 19, 1979

Inventor(s) Harald E. W. Bode

It is certified that error appears in the above-identified patent and that said Letters Patent are hereby corrected as shown below:

Column 9, line 6, "second" should read --- first ---.

Signed and Sealed this

Ninth Day of October 1979

[SEAL]

*Attest:*

RUTH C. MASON
*Attesting Officer*

LUTRELLE F. PARKER
*Acting Commissioner of Patents and Trademarks*